United States Patent [19]

Kindt et al.

[11] 4,420,358

[45] Dec. 13, 1983

[54] APPARATUS FOR THE PRODUCTION OF A GLUED WOOD JOINT

[75] Inventors: Emanuel Kindt; Joachim Sautter, both of Otelfingen, Switzerland

[73] Assignee: E. Kindt AG, Otelfingen, Switzerland

[21] Appl. No.: 304,888

[22] Filed: Sep. 23, 1981

[30] Foreign Application Priority Data

Sep. 25, 1980 [CH] Switzerland ..... 7193/80

[51] Int. Cl.[3] ..... B27G 11/00

[52] U.S. Cl. ..... 156/356; 144/330; 144/332; 144/344; 144/353; 156/547; 156/548; 156/578

[58] Field of Search ..... 144/330, 332, 344, 353; 156/547, 548, 578, 93, 356

[56] References Cited

U.S. PATENT DOCUMENTS 2,040,126 5/1936 Grieve ..... 144/330
3,031,349 4/1962 Dritz ..... 156/93 X
3,892,621 7/1975 Salonen ..... 156/578 X

FOREIGN PATENT DOCUMENTS 888041 8/1953 Fed. Rep. of Germany .
1141869 7/1963 Fed. Rep. of Germany .

OTHER PUBLICATIONS

Search report from the European Patent Office (EP 81810357.4).

*Primary Examiner*—Robert A. Dawson
*Attorney, Agent, or Firm*—Bernard, Rothwell & Brown

[57] ABSTRACT

In the process for the production of a glued joint for wood, the surfaces to be glued are held tightly together. At least one injection needle is driven into the wood up to a depth at which the outlet of the needle point comes into contact with the surface. The fluid adhesive is then driven under pressure through the injection needle and evenly distributed between the surfaces. The process is particularly suited for the production of window blind frames made of wood, in which the wood edges to be glued are joined by means of pins and slots. The process makes possible the production of joints of great strength, with very low tolerances between the pins and slots.

6 Claims, 2 Drawing Figures

APPARATUS FOR THE PRODUCTION OF A GLUED WOOD JOINT

BACKGROUND OF THE INVENTION

1. Field of Use

This invention relates to a method and apparatus for gluing frames of wood.

2. Prior Art

In existing processes for gluing the frames of wood window blinds, the pins and slots of the frame are covered with adhesive substance and the pins are inserted in the slots. In the process, a portion of the adhesive is wiped off and does not come into use. This is particularly the case when there is a slight tolerance between the pins and the slots, which in itself is desirable for a strong joint. In order to obtain an even distribution of adhesive over the surfaces and to prevent the necessity of wiping away the adhesive when the pins are inserted, large tolerances must be selected, which in turn is disadvantageous for the strength of the joint. In known wood joints employing pins and slots, the tolerances between the pins and slots are from 0.5 to 0.8 mm.

Since the gluing process is highly labor-intensive, various attempts have been made to streamline it. Thus, there are state-of-the-art adhesive application devices whose application heads are uniform with the pins and which have a number of adhesive outlets. The adhesive application heads are inserted into the slots to produce the adhesive joint. In operating the device, the adhesive leaves the holes in the application head and uniformly moistens the inner surfaces of the slots. This, however, does not resolve the problem of wiping away the layer of adhesive upon insertion of the pins into the slots. The known devices tend to be easily fouled and, in the case of an interruption in operation, to clot due to the drying of the adhesive.

For wooden blinds that are exposed to the weather, water-resistant adhesives must be employed whose handling presents special difficulties. These highly adhesive, water-proof glues are usually extraordinarily sticky and hard to handle. It is very difficult for persons performing the process to remove residues from their hands and clothing. Likewise, cleaning of the application device is laborious and time-consuming.

The object of the invention is to create a simple and easily performed process for gluing wood, one that is clean in its application and allows a problem-free use of sticky water-proof adhesives. In gluing wood parts that are joined by means of pins and slots the goal is to obtain tighter fits and thinner, evenly distributed layers of adhesive, thus assuring optimal strength for the adhesive joint. The further goal of the invention is to create a device for the streamlined execution of this process.

SUMMARY OF THE INVENTION

The invention generally relates to a process and an apparatus for the production of a glued wood joint, wherein the surfaces to be glued are held tightly together, and at least one injection needle is driven into the wood until the outlet opening at the point of the needle comes into contact with the surfaces. A fluid adhesive is delivered under pressure through the needle, so that the adhesive is evenly distributed between the surfaces. The apparatus for this purpose includes at least one injection needle which can be driven into the wood by means of a primary hydraulic control unit.

In the following, an example of one embodiment of the invention is more closely described on the basis of the diagrams.

DETAILED DESCRIPTION OF THE PREFERRED EMBODIMENT

Figure 1:
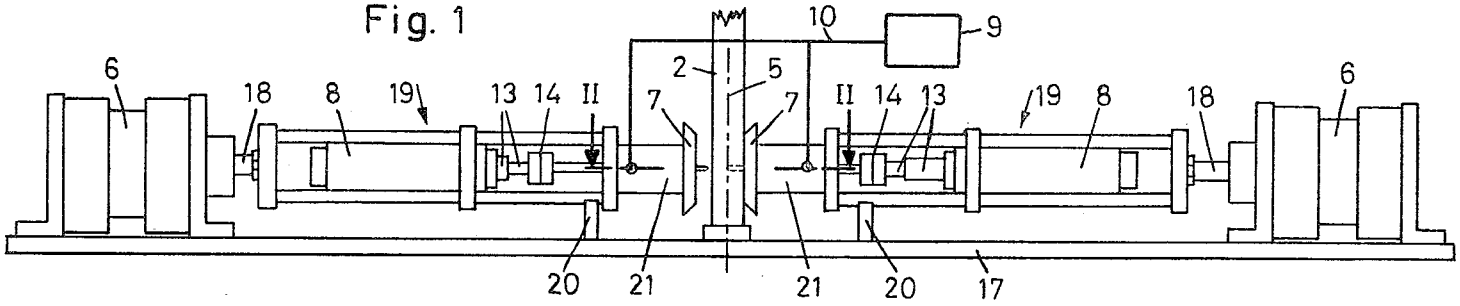
FIG. 1 is a front view of a gluing device for wood window blinds, wherein the injection needles are shown in inserted position in the right portion of the diagram, and the injection needles before insertion in the left portion.
Figure 2:
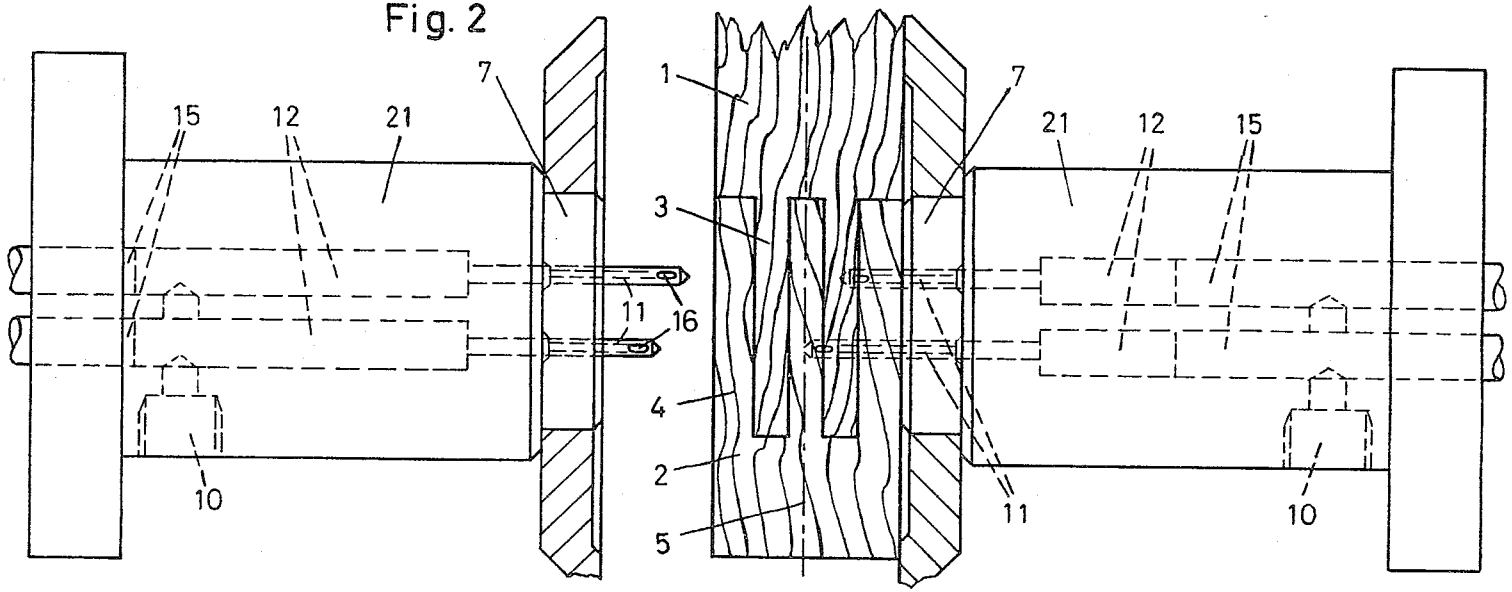
FIG. 2 is a partial section along line II—II through the central portion of the gluing device shown in FIG. 1, but on a larger scale.

The two wood edges 1 and 2 to be glued form the corner joint of a window blind made of wood and are provided with pins 3 and slots 4, which fit together. The corner joint to be glued is placed on the gluing device, whose form is symmetrical in relation to the center plane 5, and is pressed against a fitting edge not shown in greater detail. The gluing device exhibits two primary hydraulic control units 6 which press the two grip flanges 7 against the wood edges 1, 2 and hold them in position. In the process the two pairs of needles 11 emerging from the faces of the flanges 7 are driven into the wood.

Two further hydraulic control units 8 serve to press the liquid adhesive, brought from the pressurizer 9 by way of piping 10, into the injection needles 11. Each injection needle exhibits a cylindrical cavity 12, which is filled with adhesive before each injection.

The ends of the piston rods 13 of the hydraulic injection units 8 are each connected with two tampers 15 by way of couplers 14; the tampers 15 enter the cylindrical spaces 12 and press the adhesive into the needles 11. The four injection needles 11 are driven laterally into the wood, up to a depth at which their side openings 16 come into contact with the gluing surfaces at the slots 3 and pins 4. When the hydraulic injection unit 8 is operated, the adhesive is injected under high pressure between the pins and slots and is evenly distributed over the entire gluing surface. The flanges 7 serve as a seal, so that no adhesive can escape to the sides.

The two primary hydraulic control units 6 are mounted in fixed position at either end of the base plate 17 of the gluing device. There two piston rods 18 are each connected with an injection unit 19. These units are positioned on support studs 20 and can be moved together symmetrically, in horizontal fashion in relation to the center plane 5.

The hydraulic injection units 8 are housed in these two units 19; the flanges 7 are attached to the head 21 of each unit. The cylindrical cavities 12 for the adhesive are also located in this head.

The adhesive device described above makes possible the production of wood joints of very great strength, with very small tolerances between the pins and slots, ones on the order of 0.3 mm. The quantity of adhesive is determined by the tamper stroke and can be precisely adjusted, allowing an equal quantity to be released at each injection. The work cycle of the device is controlled in fully automatic fashion by an electronic control unit, which is not described in greater detail. The gluing device operates in a highly rationalized fashion and requires very little expenditure of time as compared with the conventional gluing methods.

We claim:

1. An apparatus for a glued wood joint having flat surfaces comprising: means for tightly holding together the flat surfaces to be glued; at least one injection needle which can be driven into the wood, said needle having a solid needle tip and a side outlet opening through which adhesive can be delivered; a primary hydraulic means for driving said needle into the wood up to a depth at which the side outlet opening of the needle comes into contact with the flat surfaces; the needle having an axis which extends transverse to a plane of the flat surfaces; means for delivering a precise amount of fluid adhesive through the needle under pressure to distribute the adhesive between the surfaces, and means for automatically controlling the primary hydraulic means for driving the needle into the wood and the means for delivering a precise amount of fluid adhesive through the needle.

2. The apparatus according to claim 1, wherein the means for delivering a precise amount of fluid adhesive includes at least one hydraulic injection unit having a cylindrical cavity for containing adhesive, a tamper extending into an end of said cavity and the injection needle extending from another end of the cavity; a piston rod bearing on said tamper and means secured to said piston rod for moving the tamper in the cavity to press the glue into the needle.

3. The apparatus according to claim 2, wherein a support means arranged for movement in a horizontal plane houses the hydraulic injection unit, and the primary hydraulic means is mounted to move the support means in the horizontal plane.

4. The apparatus according to claim 3, wherein the support means includes a head having a flange thereon, the injection needle projecting from the face of said flange.

5. An apparatus for a glued wood joint having flat surfaces comprising: means for tightly holding together the flat surfaces to be glued and wherein there are several injection needles positioned so that they can be driven to varying depths into the wood, each needle having a solid needle tip and a side outlet opening through which adhesive can be delivered; a primary hydraulic means for driving the needles into the wood up to a depth at which the side outlet opening of the needles comes into contact with the flat surfaces; the needles having an axis which extends transverse to a plane of the flat surfaces; means for delivering a precise amount of fluid adhesive through each needle under pressure to distribute the adhesive through the surfaces, and means for automatically controlling the primary hydraulic means for driving the needles into the wood and the means for delivering a precise amount of fluid adhesive through each needle.

6. An apparatus for a glued wood joint having flat surfaces comprising: means for tightly holding together the flat surfaces to be glued and wherein there are two pairs of injection needles positioned symmetrically in relation to a center plane and whose movement relative to each other is symmetrical and positioned so that they can be driven to varying depths into the wood, the needles having a solid needle tip and a side outlet opening through which adhesive can be delivered; a primary hydraulic means for driving the needles into the wood up to a depth at which the side outlet opening of the needles comes into contact with the flat surfaces; each needle having an axis which extends transverse to a plane of the flat surfaces; means for delivering a precise amount of fluid adhesive through each needle under pressure to distribute the adhesive between the surfaces, and means for automatically controlling the primary hydraulic means for driving the needles into the wood and the means for delivering a precise amount of fluid adhesive through the needles.

* * * * *